US005595567A

United States Patent [19]

King et al.

[11] Patent Number: 5,595,567

[45] Date of Patent: Jan. 21, 1997

[54] NONWOVEN FEMALE COMPONENT FOR REFASTENABLE FASTENING DEVICE

[75] Inventors: Willie F. King; Mark J. Kline, both of Cincinnati, Ohio

[73] Assignee: The Procter & Gamble Company, Cincinnati, Ohio

[21] Appl. No.: 287,571

[22] Filed: Aug. 9, 1994

[51] Int. Cl.[6] ..... A61F 13/15; A44B 1/04

[52] U.S. Cl. ..... 604/391; 24/442; 24/448

[58] Field of Search ..... 604/391; 24/442, 24/443, 444, 445, 446, 447, 448, 449, 450, 451, 452

[56] References Cited

U.S. PATENT DOCUMENTS

| | | |
|---|---|---|
| 2,039,312 | 5/1936 | Goldman . |
| 2,397,838 | 4/1946 | Chavannes . |
| 3,094,330 | 6/1963 | Smith . |
| 3,176,364 | 4/1965 | Dritz . |
| 3,214,323 | 10/1965 | Russell et al. . |
| 3,266,841 | 8/1966 | Altman . |
| 3,277,547 | 10/1966 | Billarant . |
| 3,319,307 | 5/1967 | Marforio . |
| 3,327,708 | 6/1967 | Sokolowski . |
| 3,405,430 | 10/1968 | Sidelman . |
| 3,469,289 | 9/1969 | Whitacre . |
| 3,490,107 | 1/1970 | Brumlik . |
| 3,494,006 | 2/1970 | Brumlik . |
| 3,665,921 | 5/1972 | Stumpf . |
| 3,665,922 | 5/1972 | Skora . |
| 3,694,867 | 10/1972 | Stumpf . |
| 3,708,833 | 1/1973 | Ribich et al. . |
| 3,895,797 | 7/1975 | Moore . |
| 3,949,128 | 4/1976 | Ostermeier . |
| 4,116,892 | 9/1978 | Schwarz . |
| 4,223,059 | 9/1980 | Schwarz . |
| 4,355,066 | 10/1982 | Newman . |
| 4,374,888 | 2/1983 | Bornslaeger . |
| 4,379,192 | 4/1983 | Wahlquist et al. . |
| 4,600,618 | 7/1986 | Raychok, Jr. et al. . |
| 4,725,473 | 2/1988 | Van Gompel et al. . |
| 4,761,318 | 8/1988 | Ott et al. . |
| 4,761,322 | 8/1988 | Raley . |
| 4,973,326 | 11/1990 | Wood et al. . |
| 5,032,122 | 7/1991 | Noel et al. . |
| 5,308,345 | 5/1994 | Herrin . |
| 5,318,555 | 6/1994 | Siebers et al. . |
| 5,326,612 | 7/1994 | Goulait . |

FOREIGN PATENT DOCUMENTS

| | | |
|---|---|---|
| 0258015 | 3/1988 | European Pat. Off. . |
| 0341993 | 11/1989 | European Pat. Off. . |
| 0604731A1 | 7/1994 | European Pat. Off. . |
| 1140576 | 1/1969 | United Kingdom . |
| 1299897 | 12/1972 | United Kingdom . |
| WO92/01401 | 2/1992 | WIPO . |
| WO94/08789 | 4/1994 | WIPO . |

*Primary Examiner*—Mary Beth O. Jones

*Attorney, Agent, or Firm*—David M. Weirich; Steven W. Miller; E. Kelly Linman

[57] ABSTRACT

A loop fastening material having an elastomeric backing joined with a nonwoven web. The backing preferably comprises an elongated orientation, a relaxed orientation and a path of response along which the backing contracts from its elongated orientation to its relaxed orientation. The nonwoven web preferably comprises filaments that are secured to each other at fixed regions by inter-fiber bonds forming a nonwoven web bonding pattern comprising nonwoven web bonding pattern elements. Between the fixed regions, the nonwoven web preferably comprises unsecured regions. The nonwoven web is preferably joined with the backing while the backing is in its elongated orientation. Construction bonds forming a construction bond pattern join the nonwoven web with the backing. In preferred embodiments of the present invention the construction bond pattern intersects with at least two points of each nonwoven web bonding pattern element. Thus, when the backing is contracted from its elongated orientation to its relaxed orientation, the unsecured regions of the nonwoven web become shirred and extend outwardly from the backing to form catching regions that are capable of entangling the engaging elements of a complementary male fastening component.

20 Claims, 3 Drawing Sheets

NONWOVEN FEMALE COMPONENT FOR REFASTENABLE FASTENING DEVICE

FIELD OF THE INVENTION

The present invention relates to a female component for refastenable hook and loop type fastening devices and, more particularly, to a low-cost female component for a hook and loop type fastening device.

BACKGROUND OF THE INVENTION

Refastenable fastening devices of the hook and loop type are currently used widely in a great number of situations. Such refastenable fastening devices have been particularly useful in clothing, disposable absorbent articles, and the like. Such devices are used when it is desirable to create a refastenable bond between two or more articles or between several surfaces of the same article. In certain applications, these refastenable fastening devices have replaced conventional buckles, zippers, buttons, snaps, tie fasteners, and sewing.

A popular type of mechanical fastener currently in wide use which utilizes mechanical entanglement to create a refastenable bond is sold under the trademark "VELCRO". VELCRO fastening devices are described in greater detail in U.S. Pat. No. 2,717,437, U.S. Pat. No. 3,009,235, U.S. Pat. No. 3,266,113, U.S. Pat. No. 3,550,837, U.S. Pat. No. 4,169,303, and U.S. Pat. No. 4,984,339.

VELCRO fasteners utilize two components. A male component and a female component. The male and female components are often referred to as the hook and loop components, respectively. The male component contains a plurality of resilient, upstanding hook shaped elements. The female component of the fastening device generally consists of a fabric containing a plurality of upstanding loops on its surface. When the male component and the loop component are pressed together in a face to face relationship to close the fastening device, the hooks entangle the loops forming a plurality of mechanical bonds between the individual hooks and loops. When these bonds have been created, the components will not generally disengage under normal conditions. This is because it is very difficult to separate the components by attempting to disengage all the hooks at once. However, when a gradual peeling force is applied to the components, disengagement can be easily effected. Under a peeling force, since the hooks are comprised of a resilient material, they will readily open to release the loops.

This type of fastening device has been found especially useful on disposable articles such as disposable garments, disposable diapers, disposable packages, cartons, and the like. Such fastening devices provide a secure closing means. However, the use of existing fastening devices of this type on disposable articles has been limited due to the fact that such fastening devices are relatively costly. A major reason that such fastening devices are costly is that they have high manufacturing costs. These high manufacturing costs are associated with both the hook and loop components of these devices.

Conventional hook and loop components are typically formed by making a fabric with a number of woven loops extending outwardly from a backing. The loops may be provided by weaving a base fabric containing supplementary threads to form the loops, or by knitting the loops into a fabric. In other hook and loop components, the loops may be formed by pleating or corrugating processes. The male components of such fastening devices are typically formed by subsequently cutting the loops. The cut loops serve as the hooks of the male component.

These processes generally produce costly hook and loop fastening materials because they are relatively slow. The hook and loop components of such fastening devices are also usually made out of the same relatively expensive material. This material is relatively expensive because the material used in the male component needs to be resilient so that the hooks can disengage from the loop component when the device is open.

Several attempts have been made to make alternative types of female components for fastening devices. However, such attempts have generally suffered from a number of drawbacks.

U.S. Pat. No. 3,694,867 issued to Stumpf on Oct. 3, 1972, discloses a "separable clasp" having a female component that comprises a "high loft" nonwoven fabric and a backing layer of consolidated flexible adhesive. However, the loop component disclosed in the Stumpf patent is prepared by performing the steps of: (1) activating an open pattern adhesive in which the fibers are imbedded, (2) consolidating the adhesive into a substantially continuous backing layer, and (3) simultaneously looping portions of the fibers such that the fibers form individual loops that extend outwardly from the backing. The female component disclosed in this patent suffers from the drawback that it is made by processes that involves mechanically manipulating fibers in the form of loops. Thus, the female components described therein do not appear to be significantly less expensive to manufacture than conventional loop components.

U.S. Pat. No. 3,708,833 issued to Ribich, et al. on Jan. 9, 1973, discloses a refastenable fastening device having a female component that comprises reticulated urethane foam secured to a backing layer. The female component disclosed in the Ribich, et al. patent suffers from the drawback that foams typically do not have enough openings for the hooks of conventional male components to penetrate. In addition, reticulated foam generally does not have sufficient strength to hold such hooks when forces are applied to the fastening device. Further, manufacturing reticulated foam is a relatively expensive process.

U.S. Pat. No. 4,761,318 issued to Ott, et al. on Aug. 2, 1988, discloses a loop fastener that can contemporaneously be both formed and also attached to a substrate without the need for any additional steps such as sewing or utilizing pressure sensitive adhesives to affix it to the substrate. However, the Ott loop fastener comprises a fibrous structure having a multiplicity of loops that is adhered to a layer of thermoplastic resin. Thus, the process disclosed in this patent suffers from the drawback that heat must be applied to bond the fibrous structure to the backing.

U.S. Pat. No. 5,032,122 issued to Noel, et al. on Jul. 16, 1991, discloses a loop fastening material having a backing of orientable material and a multiplicity of fibrous elements extending from the backing. The fibers are secured to the backing while the backing is in a dimensionally unstable state. The backing is then caused to be transformed to its dimensionally stable state thereby shearing the fibrous elements to form the catching regions of the loop material. Although the Noel patent discloses an acceptable low cost loop fastening material, the search has continued for more economical loop fastening materials and methods for producing such materials.

U.S. Pat. No. 5,318,555 issued to Siebers, et al. on Jun. 7, 1994 discloses an absorbent article having a fastening system comprising a plurality of hook members attached to one portion of the article and a plurality of loop members attached to a loop panel wherein the loop panel may be intermittently attached to the article. However, the Siebers, et al. patent focuses on the means of attaching a loop panel to an absorbent article rather than on an improved loop material itself.

Thus, it is an object of the present invention to provide an improved fastening device for disposable articles.

It is another object of the present invention to provide an improved female component of a refastenable hook and loop type fastening device.

It is a further object of the present invention to provide a female component for a hook and loop type fastening device which may be formed by joining a plurality of filaments on an elastomeric backing without manipulating the fibers into the form of loops to form a low cost loop fastening material.

It is another object of the present invention to provide a female component for a fastening device that can be used with both commercially available male components having resilient individual hooks, as well as less expensive male components with more brittle hooks than those currently in use.

These and other objects of the present invention will be more readily apparent when considered in reference to the following description and when taken in connection with the accompanying drawings.

SUMMARY OF THE INVENTION

The present invention provides a loop fastening material having an elastomeric backing joined with a nonwoven web. The backing preferably comprises an elongated orientation, a relaxed orientation and a path of response along which the backing contracts from its elongated orientation to its relaxed orientation. The nonwoven web preferably comprises filaments that are secured to each other at fixed regions by inter-fiber bonds forming a nonwoven web bonding pattern comprising nonwoven web bonding pattern elements. Between the fixed regions, the nonwoven web preferably comprises unsecured regions. The nonwoven web is preferably joined with the backing while the backing is in its elongated orientation. Construction bonds forming a construction bond pattern join the nonwoven web with the backing. In preferred embodiments of the present invention the construction bond pattern intersects with at least two points of each nonwoven web bonding pattern element. Thus, when the backing is contracted from its elongated orientation to its relaxed orientation, the unsecured regions of the nonwoven web become shirred and extend outwardly from the backing to form catching regions that are capable of entangling the engaging elements of a complementary male fastening component.

The present invention also relates to a fastening device having a hook fastening material and a loop fastening material. The loop fastening material comprises the improved loop fastening material of the present invention. The hook fastening material comprises any of the well known hook fastening materials as are known in the art and which have a base and a number of engaging elements extending from the base. The loop fastening material and the complimentary hook fastening material provide a secure closing means that will resist shear stress and peel forces encountered during use.

The present invention also relates to disposable articles and more particularly to a disposable diaper having such an improved fastening device.

DETAILED DESCRIPTION OF THE INVENTION

Overall Characteristics of the Refastenable Fastening Device

Figure 4:
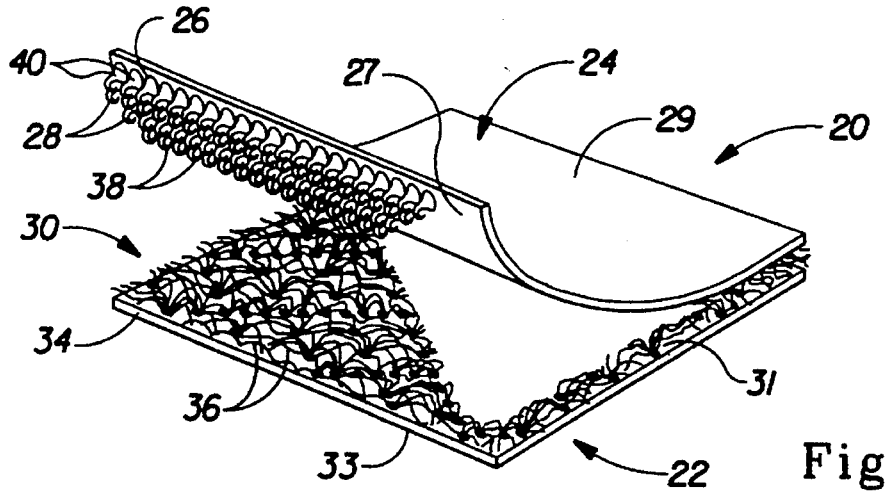
FIG. 4 is a perspective view of a fastening device according to the present invention.

A preferred embodiment of the refastenable fastening device of the present invention, fastening device 20, is shown in FIG. 4. The fastening device 20 comprises a nonwoven female component 22 and a complementary hook fastening component 24.

The female portion of the device, more specifically, the nonwoven female component (or simply "female component") 22 receives and engages the hooks 28 of the male component. The female component 22 shown in FIGS. 3 and 4 comprises at least one nonwoven web 30 secured to a backing 34. The nonwoven web 30 comprises a plurality of filaments (or fibers) 36 that entangle the hooks 28 of the male component 24. The backing 34 has a first surface 31 and a second surface 33 opposed to the first surface 31 (shown in FIG. 1), and preferably comprises an elastomeric material.

The male portion of the device, more specifically, the hook fastening component (or simply "hook component") 24, comprises a base 26 having a first surface 27 and a second surface 29. The base 26 comprises a plurality of upstanding engaging elements, or "hooks" 28, extending from the first surface 27. The term "hook" is nonlimiting in the sense that the engaging elements may be in any shape known in the art so long as they are adapted to engage a complimentary loop fastening component or the female component 22 of the present invention. The hooks 28 generally have heads 38 (or engaging means) which are disposed on top of the shanks, or stems 40, that extend from the first surface 27 of the male component 24.

The fastening device 20 of the present invention functions in the following manner. The fastening device 20 is closed when the female component 22 and the male component 24 are pressed face-to-face against each other. When this happens, the hooks 28 are entangled by the fibers 36 of the nonwoven web 30. The nonwoven web 30 provides space for the hooks, particularly, the heads 38 of the hooks to occupy when the fastening device 20 is closed. The backing 34 provides a supporting foundation for the nonwoven web 30. With the hooks 28 mechanically entangled by, or "hooked", onto the fibers 36 (shown in the portion of the fastening device 20 to the right side in FIG. 4), the connection between the components resists the forces that may be exerted on the fastening device 20.

The fastening device 20 is opened by peeling the male component 24 away from the female component 22 (or by peeling the female component 22 away from the male component 24). If the male component 24 has resilient hooks, the peeling action may cause the hooks to be bent so that they are disengaged from entanglement with the fibers 36 of the nonwoven web 30. In other cases (particularly if the hooks 28 are relatively inflexible), the hooks 28 may be separated by breaking the fibers 36 of the female component 22. In either case, the hooks 28 are disengaged and the male component 24 is completely detached from the female component 22. The fastening device 20 is then capable of being refastened in the manner described above.

The Female Fastening Component

The term "nonwoven female component", as used herein refers to a female component for a refastenable fastening device that comprises a nonwoven web joined to a backing. (The nonwoven female component may also be referred to as a loop fastening material or simply, a loop fastener.) The term "nonwoven web" refers to fabrics made of fibers held together by interlocking or inter-fiber bonding which are not woven, knitted, felted, or the like. However, the nonwoven web referred to herein may comprise fibers that are initially substantially unbonded which are subsequently bonded to each other.

Figure 1:
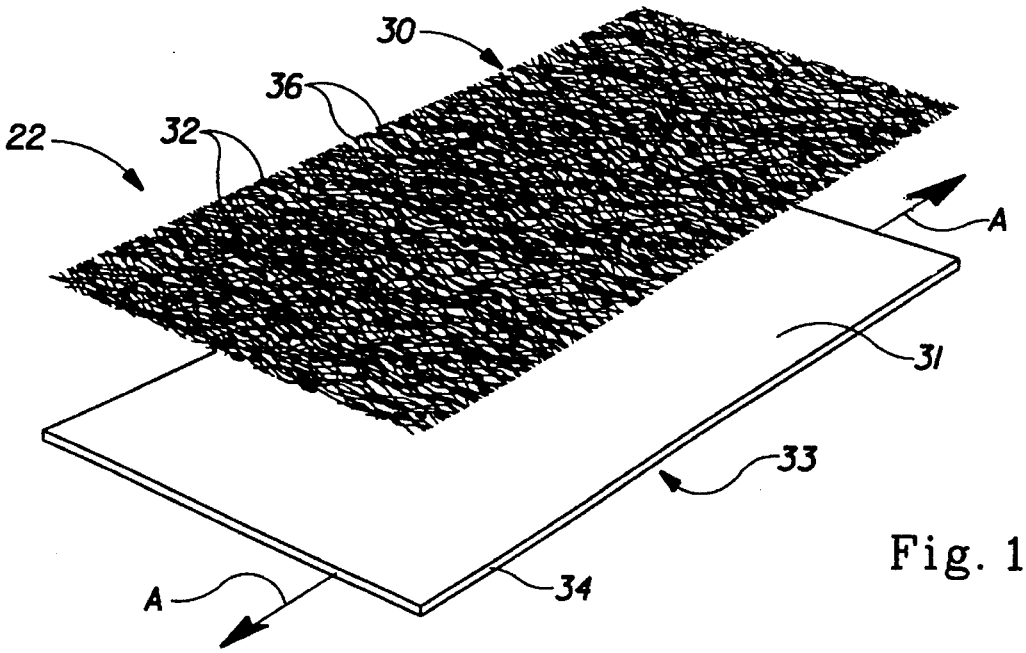
FIG. 1 is a perspective view of the filaments and the backing used to form the present invention prior to the filaments being positioned or laid down on the backing.
Figure 10:
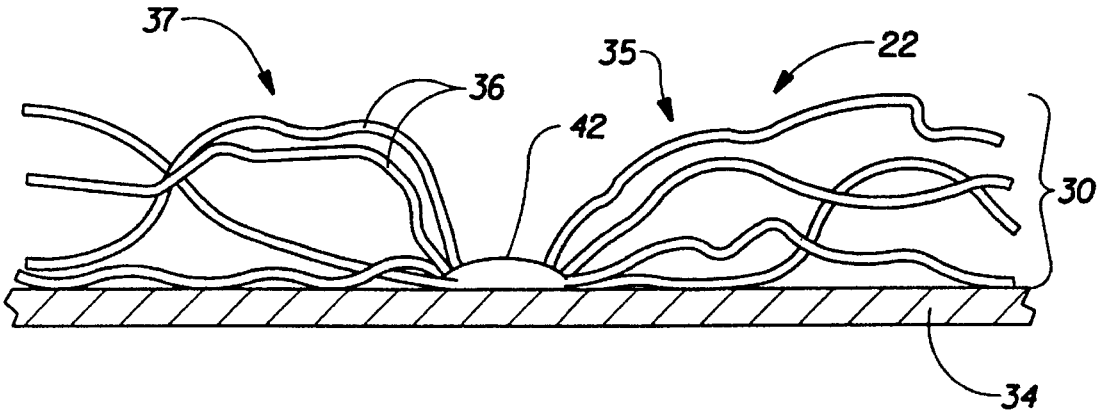
FIG. 10 is a greatly enlarged side view of the female fastening component of the present invention.

FIG. 1 shows the backing 34 and the nonwoven web 30 used to form the female component 22 prior to their association. The backing 34, preferably an elastomeric material, is shown in its elongated orientation (stretched in a direction parallel to the line designated A—A). As used herein, the term "elastomeric" refers to materials that extend in at least one direction when a force is applied and return to approximately their original dimensions after the force is released. The nonwoven web 30, as shown in greatly enlarged detail in FIG. 10, preferably comprises a multiplicity of filaments 36 having unsecured regions 35 and fixed regions 42. The fixed regions 42 comprise inter-fiber bonds 32. As used herein, the term "inter-fiber bonds" refers to bonds that join one or more filaments to one or more other filaments. The term "joined" encompasses configurations whereby an element is directly secured to another element and configurations whereby an element is indirectly secured to another element by affixing an element to intermediate member(s) which in turn are affixed to another element.

Figure 2:
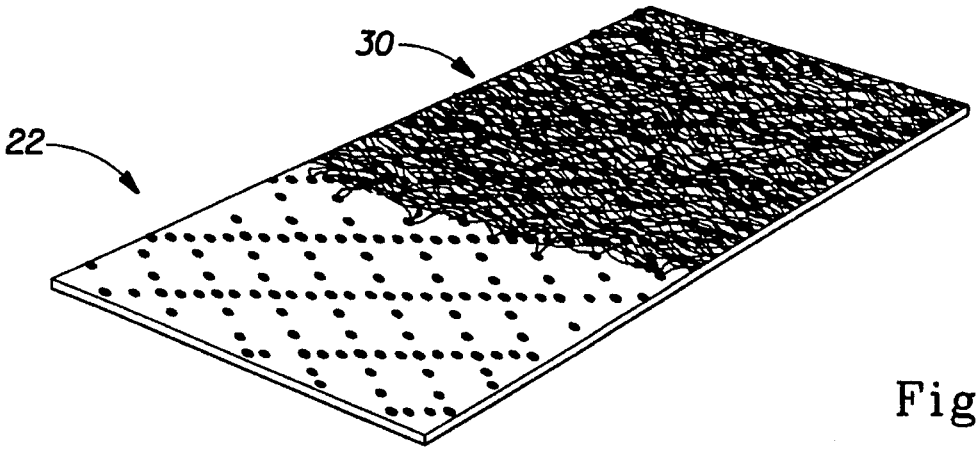
FIG. 2 is a perspective view of the female component of the present invention when the backing is in its elongated orientation.

FIG. 2 shows a preferred embodiment of the female component 22 where the backing 34 is in its elongated orientation after the nonwoven web 30 has been positioned on and joined to the first surface 31 of the backing 34. Preferably, the filaments 36 of the nonwoven web 30 are aligned essentially parallel to each other and essentially parallel to the path of response of the backing 34. ("Essentially parallel" is used herein to indicate that the filaments 36 need not extend absolutely parallel to the path of response so long as the majority of the filaments 36 extend parallel to, or a small deviation off parallel to the path of response. As used herein, the term "path of response" refers to the direction in which an elastomeric material in an elongated orientation will respond when the forces acting to elongate the elastomeric material are removed.) Further, the filaments 36 of the nonwoven web 30 are preferably in an untensioned state when they are joined to the elongated backing 34. This helps to ensure that the unsecured regions 35 of the filaments 36 will become "shirred" when the backing 34 contracts to its relaxed orientation (shown in FIG. 3). The term "shirred" as used herein, refers to the gathering of the filaments 36 of the nonwoven web 30 caused by the contraction of the backing 34 from its elongated orientation to its relaxed orientation such that portions of the filaments 36 that are not secured to the backing 34 or other filaments 36 bend away from the first surface 31 of the backing 34. The shirred unsecured regions 35 of the filaments 36 form catching regions 37 (loops) capable of entangling the hooks 28 of a complementary male fastening component 24.

As described in further detail below, the nonwoven web 30 is joined to the backing 34 with construction bonds 39. The construction bonds 39 form a particular construction bond pattern 40 that improves the effectiveness of the nonwoven web 30 as the female component of a fastening device. (The term "construction bond" as used herein, refers to bonds that join portions of the nonwoven web 30 to the backing 34.)

1. The Nonwoven Web

The catching regions 37 of the present invention are preferably formed from filaments 36 comprised in a nonwoven web positioned on and secured to the backing 34. As used herein, the term "filament" defines a member having a high ratio of length to diameter or width. Thus, a filament may be a fiber, a thread, a strand, a yarn or any other member or combination of these members, including filaments that are preattached together in nonwoven webs, as are known in the art. Suitable materials for such filaments 36 include natural fibers such as cotton or wool; synthetic fibers of nylon, polyamides, polyesters, or polyolefins; spun yarns; polyethylene fibers; polypropylene fibers; nylon fibers, nonwoven webs; or any other material or combination of materials known in the art and suitable for use herein.

The filaments 36 may be manufactured using a number of manufacturing techniques including those such that the filaments are spun, blown, or the like. Preferably, each filament 36 comprises a polypropylene fibers of between about 2 and about 15 denier. The individual filaments 36 are preferably comprised in a nonwoven web 30 which, prior to being combined with backing 34, has a basis weight of between about 10 g/yd$^2$ and about 40 g/yd$^2$ (about 12 g/m$^2$ to about 48 g/m$^2$), more preferably between about 15 g/yd$^2$ and about 25 g/yd$^2$ (about 18 g/m$^2$ and about 30 g/m$^2$). The nonwoven web 30 may comprise filaments 36 having similar or different deniers and lengths. Further, the nonwoven web 30 may comprise a mixture of filaments 36 comprising different materials. Some nonwoven webs comprising suitable filaments include the carded polypropylene nonwoven web manufactured by the Veratec Nonwoven Group of the International Paper Company, of Walpole, Mass. under the trade name P-11, the spunbonded polypropylene nonwoven web P-9, and the carded polypropylene nonwoven web P-8. Other suitable nonwoven webs comprising suitable filaments include COROVON spunbonded polypropylene manufactured by Corovin GmbH of Germany, and CELESTRA manufactured by the James River Corporation.

The lengths of the filaments 36 in the nonwoven web 30 depend upon the type of process used to make the nonwoven web 30. For instance, if a carded nonwoven web is used, the filaments 36 that comprise such a web can have lengths that range from about 0.25 inches to about 5 inches (from about 0.5 cm. to about 13 cm.). In preferred carded nonwoven webs, the filaments are between about 1 inch and about 3 inches (between about 2.5 cm. and about 8 cm.) long. Alternatively, if a spunbonded nonwoven web is used, the filaments 36 of such a web will typically be continuous length. (As used herein, the term "continuous" refers to relatively long filaments that run the entire length of the nonwoven web.)

A preferred filament 36 has a length to make at least one complete catching region 37. Thus, for example, the filament 36 may only have a pair of fixed regions 42 positioned adjacent opposite ends of the filament 36 so that the catching region 37 is formed of a whole filament 36. More preferably, the filament 36 has a number of fixed regions 42 positioned along its length to form a plurality of catching regions 37 along each filament 36. If the filaments 36 are short, or staple, complete catching regions 37 having two fixed regions 42 may not be formed. The resulting incomplete catching regions 37 may not be able to securely engage the hooks 28 of a complementary hook fastening material 24. Thus, the ability of the nonwoven female component 22 to provide a secure closure may be diminished.

The amount of inter-fiber bonding between the filaments 36 of the nonwoven web 30 is also an important factor relevant to the ability of the female component 22 of the present invention to entangle the complementary hook fastening component 24. An excessive number of bond sites created between the filaments 36 in the nonwoven web 30 will tend to interfere with the entry of hooks 28 into the nonwoven web 30, thus reducing the shear strength of the fastening device. (In general, the strength of the fastening device will be increased as more hooks are able to enter and engage the nonwoven web.) Alternatively, too few inter-fiber bonds 32 may increase the number of filaments 36 having loose (unbonded) ends, thus reducing the female component's 22 ability to entangle the hooks 28 of the complementary hook fastening component 24.

In a preferred embodiment of the present invention, the total plan view area of the inter-fiber bonds 32 is between about 1 percent and about 35 percent of the total area of the nonwoven web 30. More particularly, the total plan view area of the inter-fiber bonds is between about 5 percent and about 25 percent of the total area of the nonwoven web. The percentage of inter-fiber bonding is preferably measured by examining a representative sample of the nonwoven web under a microscope. The sample is viewed from directly above the surface of the nonwoven web 30. The plan view area of each inter-fiber bond 32 is measured. The sum of the areas of the bonds is divided by the area of the sample. The result is the percentage area occupied by the inter-fiber bonds.

The pattern of the inter-fiber bonds within the nonwoven web is another important factor relating to the strength and overall efficacy of the female component. The inter-fiber bonds 32 may comprise continuous lines or intermittent areas of bonding. Preferably, the inter-fiber bonds 32 are sufficiently close together that the filaments 36 of the nonwoven web 30 have relatively few unbonded loose ends. Thus, the distance between inter-fiber bonds 32 is preferably less than the average length of the filaments 36 in the nonwoven web 30, more preferably, less than about one-half the average length of the filaments 36 in the nonwoven web 30.

In a preferred embodiment of the present invention, the inter-fiber bonds 32 are arranged in a regular pattern, hereinafter referred to as the "nonwoven web bonding pattern" 41. (As used herein, the term "regular" refers to bond patterns that are generally similar throughout the area of the nonwoven web 30 when viewed from directly above the surface of the nonwoven web 30.) Suitable nonwoven web bonding patterns include a series of straight or curved lines or intermittent bonds that define "nonwoven web bonding pattern elements" 44. The term "nonwoven web bonding pattern elements", as used herein, refers to the areas or geometrical shapes such as squares, rectangles, hexagons, diamonds, circles, ovals, ellipses, and the like which are defined by one or more of the inter-fiber bonds 32 comprised in a nonwoven web bonding pattern. Regular nonwoven web bonding patterns 41 complement the construction bonding patterns 40, as described below, to provide a female component 22 with relatively uniform holding characteristics. However, it should be noted that neither the nonwoven bonding pattern 41 nor the nonwoven bonding pattern elements 44 must be regular. In fact, embodiments of the present invention are contemplated wherein the nonwoven bonding pattern 41 and/or the nonwoven bonding pattern elements 44 are irregular or random. Further, the nonwoven bonding pattern may be continuous or intermittent. (As used herein, the term "continuous" refers to bond patterns that are substantially unbroken or uninterrupted. The term "intermittent" refers to bond patterns that comprise a series of individual, discrete bonds that are not joined together or continuous.)

One nonwoven web bonding pattern 41 that has been found to work especially well in the female component 22 of the present invention is the intermittent diamond-shaped pattern shown in FIGS. 1 and 2. The "diamonds" in the diamond-shaped pattern comprise a number of intermittent inter-fiber bonds 32 regularly arranged in lines that define the edges of generally square shaped regions. (A preferred arrangement of the nonwoven web bonding pattern 41 before the filaments 36 become shirred is shown on the left side of FIG. 2. A preferred arrangement of the nonwoven web bonding pattern 41 after the filaments 36 have become shirred is shown on the left side of FIG. 3.). The pattern is rotated approximately 45 degrees to give the appearance of diamonds. Preferably, the dimensions of the nonwoven web bonding pattern 41 should be such that the distance between the inter-fiber bonds 32, in at least some portion of the area between the sides of the diamond-shaped areas, is greater than the projected plan view dimensions of the hooks 28 of the complementary male component 24. (Plan view dimensions of complementary male components are discussed in greater detail below.) Nonlimiting examples of diamond-shaped bonding patterns suitable for use in the female fastening component 22 of the present invention include patterns having sides that measure between about ½ inch×½ inch (about 1.3 cm.×1.3 cm.) and about ⅛ in×⅛ in. (about 0.3 cm.×0.3 cm.), more preferably between about ¼ inch×¼ inch (about 0.6 cm.×0.6 cm.) and about ⅜ inch×⅜ inch (about 1 cm.×1 cm.), and most preferably about ¼ inch×¼ inch (about 0.6 cm.×0.6 cm.). A suitable nonwoven web 30 comprising inter-fiber bonds 32 arranged in a diamond-shaped pattern is available from the Veratec Nonwoven Group of the International Paper Company, of Walpole, Mass. under the trade name P-11.

The inter-fiber bonds 32 that create the nonwoven web bonding pattern 41 may be produced by any method that is known in the art. In a preferred embodiment, the inter-fiber bonds 32 are produced by passing a nonwoven web 30 through a pair of rollers that have been heated close to the melting point of the filaments 36 comprised in the nonwoven web 30. One of the rollers preferably has a smooth surface; the complementary roller has a pattern of pins extending from its surface in the diamond-shaped pattern described above. When the nonwoven web 30 passes between the rollers, the heat and pressure of the rollers causes distinct regions of the filaments 36 to melt producing inter-fiber bonds 32 in the preferred diamond-shaped pattern.

The nonwoven web 30 is preferably positioned on and joined with the backing 34 while the backing 34 is in an elongated orientation and while the filaments 36 are in an untensioned condition. While the filaments 36 could conceivably be positioned on the backing 34 in a tensioned or unstable state, such is not preferred to provide maximum shirring of the filaments 36. Further, while the backing 34 could be in a relaxed orientation when the filaments 36 are positioned on the backing 34, this is not preferred because in causing the backing 34 to become elongated, enough filaments 36 may be dislocated, disarranged, skewed or bonded to the backing 34 such that the catching regions 37 would not be as effective in engaging the hook fastening component.

The configuration in which the filaments 36 are positioned or laid down on the backing 34 determines the size and the ability of the loop fastening component 22 to provide an effective fastening device. While the filaments 36 may be randomly positioned on the backing 34 such that the filaments 36 overlap or extend in many different directions, it has been found that the filaments 36 should preferably be positioned as parallel with each other as possible to provide catching regions 37 configured in a uniform direction. In addition, while the filaments 36 may be positioned lengthwise on the backing 34 in any direction, in order to take advantage of the maximum shirring effect of the backing 34 to form catching regions 37 of maximum height, the filaments 36 are preferably positioned on the backing 34 in a direction essentially parallel to the path of response of the backing 34. (It has been found, however, that filaments 36 positioned essentially perpendicular to the path of response also provide suitable entangling ability.) The filaments 36 may be positioned or laid down on the backing 34 by any method or means that is known in the art.

2. The Backing

The backing 34 of the present invention is that part of the female fastening component 22 to which the nonwoven web 30 is secured. The backing 34 is preferably comprised of an elastomeric material. As used herein, the term "elastomeric" refers to materials that extend in at least one direction when a force is applied and return to approximately their original dimensions after the force is removed. Thus, elastomeric materials have an elongated orientation (when force is applied), a relaxed orientation (when force is removed), and a path of response along which the backing 34 contracts from its elongated orientation to its relaxed orientation. In a preferred embodiment of the present invention, the backing 34 will be elongated in the machine direction prior to its association with the nonwoven web 30. (As used herein, the term "machine direction" refers to the direction in which the materials move as the materials move forward through any processing steps. The term "cross machine direction" refers to the direction perpendicular to the machine direction.)

The backing 34 of the present invention may take on a number of different configurations. For example, the backing 34 may comprise a thin film having a uniform or varying thickness, slits, holes, deformations or the like; a laminate of two or more films; single or multiple strands of films or laminates; or any combination of the above. In one preferred embodiment, the backing 34 comprises a thin film of about 0.013 mm. to about 1.0 mm. (about 0.0005 in. to about 0.04 in.). In a particularly preferred embodiment, the elastomeric film has a thickness of between about 0.013 mm. to about 0.38 mm (about 0.0005 in. to about 0.015 in.).

The backing 34 may comprise any of a number of different elastomeric materials known in the art. The backing 34 preferably has an elastic modulus between about 1 and about 30 PSI and more preferably between about 5 and about 15 PSI. (The elastic modulus calculation is preferably determined on the strain interval of about 5% to about 50% elongation of any convenient gage length using the original cross sectional area of the sample prior to straining the sample to determine the elastic modulus.) Further, the backing 34 should be capable of elongation from about 10 to about 500 percent in at least one direction without rupture. More preferably, the backing 34 should be capable of between about 10 percent and about 500 percent elongation without rupture, not exhibit excessive necking or thinning when elongated, or exhibit excessive hysteresis or delamination upon elongation. Examples of suitable backing materials include but are not limited to butadiene/acrylonitrile copolymers, styrene-butadiene-styrene block copolymers, polyurethane elastomers, natural rubber, ethylene propylene-dimonomers, polypropylene films, as well as polyethylene films available from the Clopay Corporation of Cincinnati, Ohio (e.g. Clopay 1401), and Tredegar Film Products, Inc of Terre Haute, Ind., and the styrene-isoprene-styrene block copolymer film EXX500 available from the Exxon Chemical Company of Lake Zurich, Ill.

3. The Construction Bonds and Bonding Pattern

The present invention comprises a construction bond pattern 40 comprising at least one construction bond 39. The construction bond 39 is that part of the female fastening component 22 which joins the nonwoven web 30 with the backing 34. It has been found that particular construction bond patterns 40 unexpectedly increase the effectiveness of certain nonwoven web 30 and backing 34 combinations as female fastening components 22. In particular, it has been found that construction bond patterns 40 that intersect with at least two points of each of the nonwoven bonding pattern elements 44, as described above, provide the resulting female fastening component 22 with the ability to more strongly catch and secure the engaging elements of complementary male fastening components 24.

The construction bonds 39 may comprise any number of different types of bonds as are known in the art. For example, the construction bonds 39 may comprise adhesives, including pressure sensitive adhesives, hot melt adhesives that are extruded, slot coated, screen or gravure printed; ultrasonic bonds; heat bonds, pressure bonds, friction bonds, autogenous bonds or any combination of these or any other bonding methods as are known in the art. Some examples of preferred construction bond 39 adhesives comprise hot melt adhesives manufactured by the Findley Adhesives Corporation of Wauwatosa, Wis. under the trade names H2031, H2085, and H2305.

The construction bond pattern 40 comprises at least one construction bond 39, as described above. However, the construction bond pattern may comprise any number of construction bonds 39 and may be regular or irregular. Further, the construction bond pattern 40 may comprise a series of straight or curved lines, or intermittent or continuous bonds that define at least one "construction bond pattern element" 45. (Shown in FIGS. 5–7) The term "construction bond pattern element", as used herein, refers to the individual areas or geometrical shapes which are defined by one or more of the construction bonds 39 comprised in the construction bond pattern 40. Suitable construction bond pattern elements 45 may take on any number of different configurations, including diamonds, ovals, squares, circles, ellipses, lines, spirals, dots or any other regular or irregular polygons, shapes or patterns. However, the benefits of the present invention are best achieved when the construction bond pattern 40 intersects with at least two points of each of the nonwoven bonding pattern elements 44. As used herein, the term "intersects" refers to distinct points wherein at least a portion of one construction bond 39 touches, overlaps, or is coincident with at least a portion of a nonwoven web bonding pattern element 44 such that the construction bond 39 and the nonwoven web bonding element 44 are joined at that point. (Some points of intersection between the construction bond(s) 39 and nonwoven web bonding pattern elements 44 are shown in FIGS. 5, 6 and 7, and designated "I".)

Figure 5:
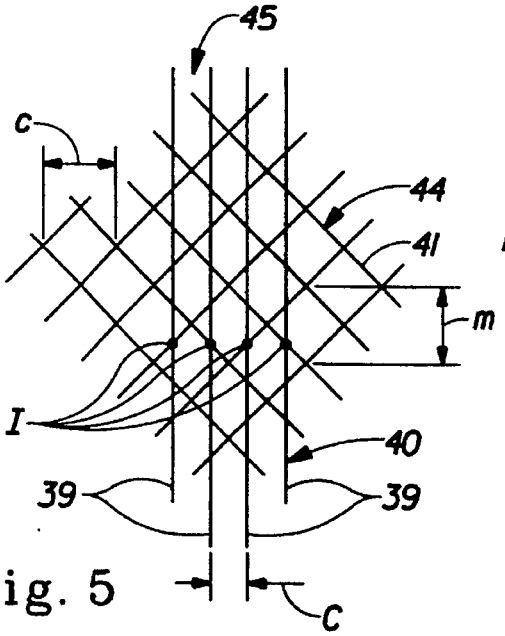
FIG. 5 is a perspective view of the nonwoven web bonding pattern and the construction bond pattern of a preferred embodiment of the present invention with the filaments of the nonwoven web deleted to show more detail with respect to the bonding patterns.
Figure 6:
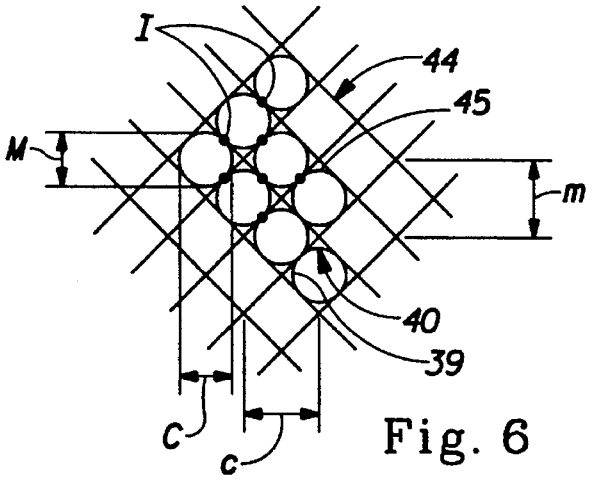
FIG. 6 is a perspective view of the nonwoven web bonding pattern and the construction bond pattern of another preferred embodiment of the present invention with the filaments of the nonwoven web deleted to show more detail with respect to the bonding patterns.
Figure 7:
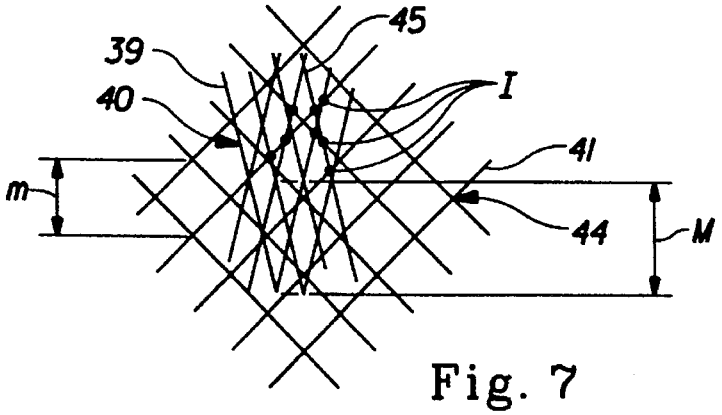
FIG. 7 is a perspective view of the nonwoven web bonding pattern and the construction bond pattern of yet another preferred embodiment of the present invention with the filaments of the nonwoven web deleted to show more detail with respect to the bonding patterns.

As shown in FIGS. 5, 6, and 7 the greatest distance in the cross machine direction between two points of any construction bond pattern element 45 is designated "C", and the greatest distance in the machine direction between two points of any construction bond pattern element 45 is designated "M". (In the case of construction bonds 39 that are parallel to each other, as shown in FIG. 5, "M" would be equal to infinity.) Further, the greatest distance in the cross machine direction between two points of any of the nonwoven web bonding pattern element 44 is denoted "c", and the greatest distance in the machine direction between two points of any of the nonwoven web bonding pattern element 44 is denoted "m". Thus, a cross direction bond ratio, hereinafter referred to as the "CD bond ratio", can be represented by the formula c/C, and a machine direction bond ratio, hereinafter referred to as the "MD bond ratio" can be represented by the equation m/M.

It has been found that the CD bond ratio and the MD bond ratio have an impact on the ability of the female fastening component 22 to engage the hooks 22 of a complementary male fastening component 24. In particularly preferred embodiments of the present invention, the CD bond ratio and the MD bond ratio equal 1 and the construction bond pattern 40 is coincident with the nonwoven web bonding pattern 41. (As used herein, the term "coincident" refers to bonds or portions of bonds that overlap or occupy generally the same space.) In other preferred embodiments, the CD bond ratio is as great as possible up to the point where the frequency of the construction bonds 39 interferes with the ability of the engaging elements of the complementary male fastening component 24 from properly entering the catching regions 37 of the female fastening component 22. A CD bond ratio greater than or equal to one and less than 3 is preferred. More preferably, a CD bond ratio of between 1 and 2 is preferred, and particularly preferred is a CD bond ratio of 1.67. (Of course, the preferred CD bond ratio may vary with the exact nonwoven web bonding pattern 41 that is utilized.) Preferably, the MD bond ratio is less than or equal to one. If the construction bond pattern 40 is not coincident with the nonwoven web bonding pattern 41, it is preferred that the MD bond ratio approach zero (i.e. the construction bonds 39 are parallel with each other). A low MD bond ratio coupled with a preferred CD bond ratio, as discussed above, helps to ensures that a suitable number of unsecured regions 35 will be available to become shirred when the backing 34 is contracted such that a sufficient number of catching regions can be formed to engage a complementary male component 24.

In one preferred embodiment of the present invention, the nonwoven web bonding pattern 41 comprises a multiplicity of regularly spaced diamond shaped nonwoven web bonding pattern elements 44, as described above with respect to the nonwoven web, and as shown in FIG. 5. (A suitable nonwoven web 30 with such a nonwoven web bonding pattern 41 is commercially available from the Veratec Nonwoven Group of the International Paper Company of Walpole, Mass. under the trade name P-11.) Further, the construction bond pattern 40 preferably comprises a multiplicity of substantially parallel construction bonds 39. (The term "substantially parallel", as used herein, is used to indicate that the construction bonds 39 need not be absolutely parallel to each other so long as the bonds no more than a small deviation off parallel with each other.) Preferably, the construction bonds 39 run substantially parallel to the path of response of the backing 34.

In another preferred embodiment of the present invention, as shown in FIG. 6, the nonwoven web bonding pattern 41 again comprises "diamond" shaped nonwoven web bonding pattern elements 44 while the construction bond pattern 40 comprises a series of essentially circular construction bonds 39. (As used herein, the term "essentially circular" includes but is not limited to the following closed curves: circles, ellipses, ovals, spirals and the like.) Again, as shown FIG. 6, the construction bond pattern 40 intersects with at least two points on each of the nonwoven web bonding pattern elements 44.

In yet another preferred embodiment of the present invention, as shown in FIG. 7, the nonwoven web bonding pattern 41 comprises "diamond" shaped nonwoven web bonding pattern elements 44 while the construction bond pattern 40 comprises a multiplicity of construction bonds 39 in the form of parallel and nonparallel lines. The construction bonds 39 form a construction bond pattern 40 comprising "diamond" shapes similar to those of the nonwoven web bonding pattern 41. As with the other exemplary preferred embodiments, the construction bond pattern 40 intersects with at least two points on each nonwoven web bonding pattern element 44.

Method of Manufacturing the Nonwoven Female Component

Figure 3:
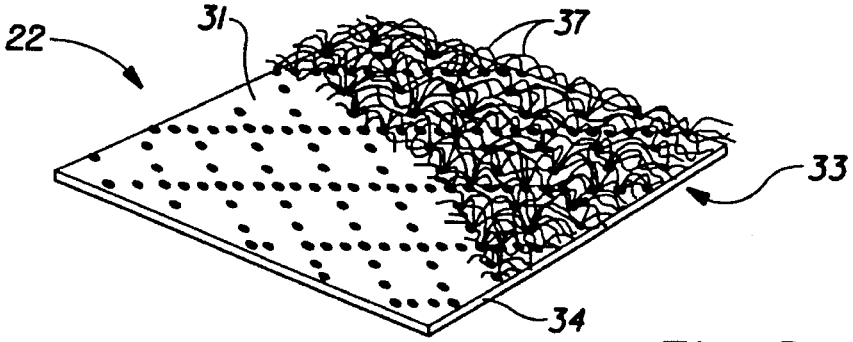
FIG. 3 is a perspective view of the female component of the present invention when the backing is in its relaxed orientation.

The female fastening component 22 of the present invention may be manufactured by any means as are known in the art. (FIGS. 1 through 3 are illustrative of the preferred steps involved in the process for making female fastening component 22) As shown in FIG. 1, a nonwoven web 30 is provided preferably comprising inter-fiber bonds 32 that make up a nonwoven web bonding pattern 41 comprising nonwoven web bonding pattern elements 44. An elastomeric backing 34 is provided in an elongated orientation (preferably the elongation is in the machine direction as shown in FIGS. 1 and 2). Construction bond(s) 39 that form the construction bond pattern 40, may be provided before or after the backing 34 has been elongated. Further, the construction bond(s) 39 may be provided on the first surface 31 of the backing 34 before the nonwoven web 30 is placed in contact with the backing 34, as is preferred in the case of adhesive bonds, may be introduced after the nonwoven web 30 has been placed in contact with the backing 34, or may be provided on the surface of the nonwoven web 30 that is to contact the backing 34. In preferred embodiments, the nonwoven web 30 is joined to the first surface 31 of the backing 34 while the backing 34 is in its elongated orientation. The backing 34 then contracts to its relaxed condition. This causes the portions of the filaments 36 of the nonwoven web 30 that are not secured to the backing 34 or other filaments 36 to bend outwardly away from the first surface 31 of the backing 34. The shirred unsecured regions 35 form the catching regions 37 that are capable of entangling the engaging elements of a complementary male fastening component.

In especially preferred embodiments of the present invention, the filaments 36 of the nonwoven web 30 are aligned essentially parallel to each other and essentially parallel to the path of response of the backing 34. Further, the nonwoven web 30 is preferably placed in contact with the backing while the nonwoven web 30 is in an untensioned state. These measures help to ensure that the unsecured regions 35 of the filaments 36 that form the catching regions 37 become shirred when the backing 34 is contracted and that the catching regions 37 formed are effective in engaging the desired complementary male fastening components.

The Complementary Male Component

The term "male component", as used herein, is used to designate the portion of the fastening device 20 having engaging elements, such as hooks 28. The male components 24 used with the nonwoven female component 22 of the present invention can be conventional, commercially available hook materials. The male component 24, however, is not limited to conventional materials with flexible, resilient hooks 28. Suitable male components can have less expensive, relatively inflexible, more brittle hooks. Further, the engaging elements may have any shape known in the art such as hooks, "T's", mushrooms, or any other shape. One suitable male component 24 may comprise a number of shaped engaging elements projecting from a woven backing such as the commercially available material designated "SCOTCHMATE" brand No. FJ3402 available from Minnesota Mining and Manufacturing Company, St. Paul, Minn. Other preferred male components 24 are available from Aplix, Inc. of Charlotte, N.C. under the trade names 957c or 957d. U.S. Pat. No. 4,846,815 entitled "Disposable Diaper Having An Improved Fastening Device" which issued to C. L. Scripps on Jul. 11, 1989 describes another preferred male component suitable for use with the present invention. Other particularly preferred male components and methods for making the same are the prongs described in U.S. Pat. No. 5,058,247 entitled "Mechanical Fastening Prong" issued to Thomas et al. on Oct. 22, 1991; U.S. Pat. No. 5,116,563 entitled "Process for Producing a Mechanical Fastener" issued to Thomas et al. on May 26, 1992; U.S. Pat. No. 5,180,534 entitled "Process of Manufacturing A Refastenable Mechanical Fastening System", which issued to Thomas, et al. on Jan. 19, 1993; and U.S. Pat. No. 5,230,851 entitled "Process of Manufacturing a Refastenable Fastening System" issued to Thomas on Jul. 27, 1993. Each of these patents are hereby incorporated by reference herein.

The male component 24 may be manufactured from a wide range of materials. Such suitable materials include, but are not limited to, nylon, polyester, polypropylene, or any combination of these or other materials.

Examples of Uses of the Refastenable Fastening Device

The refastenable fastening device of the present invention is especially useful as a fastening device for disposable absorbent articles. The term "disposable absorbent article", as used herein, refers to articles which absorb and contain body exudates. More particularly, the term refers to articles which are placed against or in proximity to the body of the wearer to absorb and contain the various exudates discharged from the body. The term "disposable" means that such articles are intended to be discarded after a single use (i.e., they are not intended to be laundered or otherwise be used). Examples of disposable absorbent articles include diapers, incontinence garments, sanitary napkins, bandages, and the like.

Figure 8:
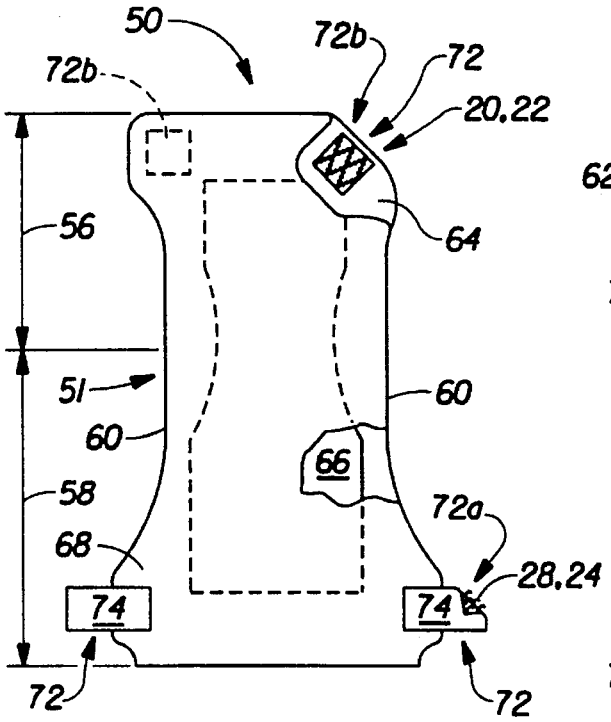
FIG. 8 is a perspective view of a disposable diaper that includes the female fastening component of the present invention.
Figure 9:
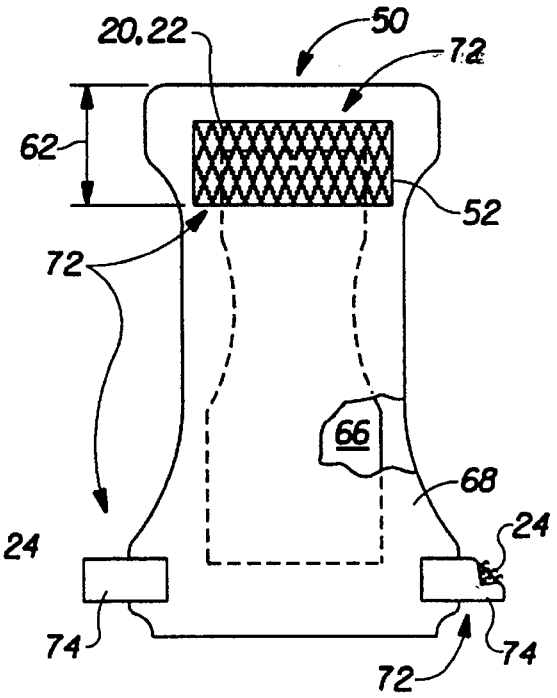
FIG. 9 is a perspective view of a disposable diaper that includes the female fastening component of the present invention.

FIGS. 8 and 9 show an exemplary disposable diaper 50 comprising a fastening system 72 including the nonwoven female fastening component 22 of the present invention. The diaper 50 preferably comprises a body portion 51 and two waist regions, a first waist region 56, and a second waist region 58. The body portion 51 preferably comprises a liquid pervious topsheet 64, a liquid impervious backsheet 68, and an absorbent core 66.

As shown in FIG. 8, the fastening system 72 of the diaper 50 comprises the female fastening component 22 of the present invention, among other elements. The fastening system 72 may take on a number of configurations and constructions. In one preferred embodiment, the first fastening element **72*a* comprises a male component 24. The male component 24 provides hooks 28 that extend from the tab 74 disposed in the second waist region 58. The nonwoven female component 22 of the present invention comprises the second fastening element 72*b* disposed in the first waist region 56. However, the positions of the components of the fastening device 20 of the present invention could be reversed so that the first fastening element 72*a* comprises the nonwoven female component 22 and the second fastening element 72*b* comprises the male component 24**.

In an especially preferred embodiment of the disposable diaper 50, the filaments 36 in the nonwoven web 30 of the female component 22 are aligned in a single direction. The female component 22 is oriented so that the filaments 36 in the nonwoven web 30 extend essentially parallel to the longitudinal edges 60 of the diaper 50. This orientation aligns the filaments 36 generally perpendicular to the direction of shear forces applied to the fastening device 20 during use. In this configuration the filaments 36 provide the maximum peel and shear force resistance.

Several examples of well known diaper configurations to which the present invention can be readily adapted are described in U.S. Pat. Nos. 5,151,092 and 5,221,274 both entitled "Absorbent Article With Dynamic Elastic Waist Feature Having A Predisposed Flexural Hinge", issued to Kenneth B. Buell, et al. on Sep. 29, 1992 and Jun. 22, 1993, respectively; co-pending U.S. patent application Ser. No. 08/155,048 entitled "Absorbent Article With Multi-Directional Extensible Side Panels", filed Nov. 19, 1993; and co-pending U.S. patent application Ser. No. 08/203,456 entitled "Absorbent Article With Multiple Zone Structural Elastic-Like Film Web Extensible Waist Feature" filed on Feb. 28, 1994. Each of the above mentioned patents and co-pending patent applications are hereby incorporated by reference herein. It should be understood, however, that the fastening device of the present invention is not limited to use with any specific diaper structure or configuration.

The female fastening component 22 of the present invention may also be used to provide an inexpensive waistband, or any other elastomeric element (or a portion thereof) of an absorbent article, capable of engaging the hooks 28 of a complementary male fastening component 24. (As used herein, the term "waistband" refers to that portion of an absorbent article that partially or wholly encircles the waist of the wearer.) FIG. 8 shows a diaper 50 having a waistband 62 comprising the female fastening component 22 of the present invention. Further examples of diapers suitable for use with the present invention are described in U.S. Pat. No. 4,699,622 entitled "Disposable Diaper Having An Improved Side Closure" which issued to J. W. Toussant, et al. on Oct. 13, 1987; U.S. Pat. No. 5,019,065 entitled "Disposable Absorbent Article With Combination Mechanical and Adhesive Tape Fastener System", issued to Scripps on May 28, 1991; and U.S. Pat. No. 5,242,436 entitled "Absorbent Article With Fastening System Providing Dynamic Elasticized Waistband Fit", issued to Weil et al., on Sep. 7, 1993; each of which is hereby incorporated by reference herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A female component of a refastenable fastening device capable of engaging a complementary hook fastening component, said female component comprising:

a backing having an elongated orientation, a relaxed orientation, and a path of response along which said backing contracts from said elongated orientation to said relaxed orientation; and a nonwoven web in contact with said backing, said nonwoven web comprising filaments having unsecured regions and fixed regions, said fixed regions comprising inter-fiber bonds joining said filaments and forming a nonwoven bonding pattern comprising a multiplicity of nonwoven bonding pattern elements; and a construction bond pattern comprising at least one construction bond for joining said nonwoven web with said backing, said construction bond pattern intersecting with at least two points of each of said nonwoven bonding pattern elements, wherein said unsecured regions of said filaments are shirred when said backing is caused to return to its relaxed orientation, forming catching regions capable of entangling the male component of a refastenable fastening device.

2. The female fastening component of claim 1 having a CD bond pattern ratio that is greater than or equal to 1.

3. The female fastening component of claims 1 or 2 having a MD bond ratio less than or equal to 1.

4. The female fastening component of claim 1 wherein said construction bonding pattern comprises a multiplicity of substantially parallel construction bonds.

5. The female fastening component of claim 4 wherein said construction bonds are substantially parallel with said path of response of said backing.

6. The female fastening component of claim 1 wherein said construction bond pattern comprises at least one construction bond in a diamond shape.

7. The female fastening component of claim 1 wherein said construction bond pattern comprises at least one essentially circular construction bond.

8. The female fastening component of claims 5, 6, or 7 wherein said CD bond ratio is greater than or equal to 1.

9. The female fastening component of claim 8 wherein said MD bond ratio is less than or equal to 1.

10. The female fastening component of claim 1 wherein said backing comprises a polyurethane elastomer.

11. A female component of a refastenable fastening device capable of engaging a complementary hook fastening component, said female component comprising:

a backing having an elongated orientation, a relaxed orientation, and a path of response along which said backing contracts from said elongated orientation to said relaxed orientation, said backing comprising an elastomeric film selected from the following group: polyethylene film, polypropylene film, ethyl vinyl acetate film, styrene-isoprene-styrene block copolymer film or styrene-butadiene-styrene block copolymer film; and a nonwoven web in contact with said backing, said nonwoven web comprising filaments having unsecured regions and fixed regions, said fixed regions comprising inter-fiber bonds joining said filaments and forming a nonwoven bonding pattern comprising a multiplicity of nonwoven bonding pattern elements; and a construction bond pattern comprising at least one construction bond for joining said nonwoven web with said backing, said construction bond(s) selected from the following group: pressure sensitive adhesive bonds, hot melt adhesive bonds, ultrasonic bonds, heat bonds, pressure bonds, friction bonds or autogenous bonds, wherein said construction bond patterns intersect with at least two points of each of said nonwoven bonding pattern elements such that said unsecured regions of said filaments are shirred when said backing is caused to return to its relaxed orientation, forming catching regions capable of entangling the male component of a refastenable fastening device.

12. The female fastening component of claim 11 wherein said nonwoven web bonding pattern comprises a regular pattern of diamond-shaped nonwoven web bonding pattern elements.

13. The female fastening component of claim 12 wherein said construction bond pattern comprises at least one construction bond in a diamond shape.

14. The female fastening component of claim 13 having a CD bond pattern ratio that is greater than or equal to 1.

15. The female fastening component of claim 14 having a MD bond pattern ratio that is less than or equal to 1.

16. The female fastening component of claim 13 wherein said construction bond pattern is generally coincident with said nonwoven web bonding pattern.

17. The female fastening component of claim 13 wherein said filaments are positioned on said backing essentially parallel to said path of response of said backing.

18. The female fastening component of claims 5, 6, 7, or 13 having a CD bond pattern ratio that is between about 1 and about 2.

19. The female fastening component of claims 5, 6, 7, or 13 having a CD bond pattern ratio that is about 1.67.

20. A disposable absorbent article comprising a liquid pervious topsheet, a liquid impervious backsheet joined with said topsheet, an absorbent core positioned between said topsheet and said backsheet, and a fastening system for fastening said disposable absorbent article about a wearer, wherein said fastening system comprises the female fastening component of claims 1, 5, 6, 7 or 13.

* * * * *